US009305535B2

(12) United States Patent
Pinder et al.

(10) Patent No.: US 9,305,535 B2
(45) Date of Patent: Apr. 5, 2016

(54) SAFETY ALERT APPARATUS FOR A PORTABLE COMMUNICATION DEVICE

(71) Applicant: MOTOROLA SOLUTIONS, INC, Schaumburg, IL (US)

(72) Inventors: Ellis A. Pinder, Davie, FL (US); Lanting L. Garra, Sunrise, FL (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 308 days.

(21) Appl. No.: 13/901,840

(22) Filed: May 24, 2013

(65) Prior Publication Data

US 2014/0345514 A1 Nov. 27, 2014

(51) Int. Cl.

| | |
|---|---|
| ***G10K 5/00*** | (2006.01) |
| ***G08B 1/08*** | (2006.01) |
| ***G08B 25/00*** | (2006.01) |
| ***G08B 25/01*** | (2006.01) |

(52) U.S. Cl.

CPC .. *G10K 5/00* (2013.01); *G08B 1/08* (2013.01); *G08B 25/009* (2013.01); *G08B 25/016* (2013.01)

(58) Field of Classification Search

CPC ..... G08B 3/1041; G08B 5/006

See application file for complete search history.

(56) References Cited

U.S. PATENT DOCUMENTS

| | | | | |
|---|---|---|---|---|
| 2,943,188 | A * | 6/1960 | Knott et al. | 455/85 |
| 5,081,709 | A | 1/1992 | Benyo et al. | |
| 5,185,906 | A | 2/1993 | Brooks | |
| 5,379,490 | A | 1/1995 | Wandt et al. | |
| 5,528,770 | A | 6/1996 | Castilla et al. | |
| 5,979,019 | A | 11/1999 | Johnson | |
| 6,018,848 | A | 2/2000 | Nilsen et al. | |
| 6,032,337 | A | 3/2000 | Rankin, Jr. et al. | |
| 6,105,923 | A | 8/2000 | Robertson et al. | |
| 6,125,513 | A | 10/2000 | Cheraso et al. | |
| 6,603,711 | B2 | 8/2003 | Calace | |
| 6,668,428 | B2 | 12/2003 | Moeller | |
| 7,580,725 | B2 | 8/2009 | Delker et al. | |
| 8,306,582 | B2 | 11/2012 | Williams et al. | |
| 8,312,602 | B2 | 11/2012 | Paik | |
| 2005/0162257 | A1 | 7/2005 | Gonzalez | |
| 2005/0198789 | A1 | 9/2005 | Wang | |
| 2008/0064339 | A1 | 3/2008 | Cavalier | |
| 2010/0069117 | A1* | 3/2010 | Knighton | 455/557 |
| 2010/0080087 | A1 | 4/2010 | Shupp | |
| 2010/0115736 | A1* | 5/2010 | Paik | 24/163 R |
| 2011/0101053 | A1 | 5/2011 | Liang | |
| 2012/0257377 | A1 | 10/2012 | Schrimmer et al. | |
| 2012/0262909 | A1 | 10/2012 | Campman | |
| 2012/0282976 | A1* | 11/2012 | Suhami | 455/556.1 |

FOREIGN PATENT DOCUMENTS

| | | |
|---|---|---|
| CN | 201270067 Y | 7/2009 |
| JP | 2003298710 | 10/2003 |

* cited by examiner

*Primary Examiner* — Daniel S Larkin
*Assistant Examiner* — Irving A Campbell
(74) *Attorney, Agent, or Firm* — Barbara R. Dourte

(57) ABSTRACT

A safety alert device (200) is formed of a clip (210) and integrated whistle (220) coupled to a portable communication device (300). The clip and integrated whistle can be removed or re-oriented from the radio (300) to provide user access to the whistle. The removal or rotation of the safety alert device (200) having clip and integrated whistle can further enable emergency radio mode operation. The whistle (220) operates as a safety alert when the battery of the portable communication device is either charged or discharged.

20 Claims, 5 Drawing Sheets

SAFETY ALERT APPARATUS FOR A PORTABLE COMMUNICATION DEVICE

FIELD OF THE DISCLOSURE

The present disclosure relates generally to portable communication devices and more particularly to portable communication devices that provide safety alerts.

BACKGROUND

Portable communication devices, such as battery operated portable two-way radios, are often used in leisure activities such as hiking, boating, and other activities as a means to maintain contact with others for safety reasons. Unlike cell phones, which are prone to dead spots or areas of poor reception and transmission, the portable two-way radio is typically a more robust device that allows a user to communicate with many users with the push of a button. However, a low battery condition may inhibit the use of a portable two-way radio, thereby minimizing safety effectiveness. Additional safety measures that could be utilized with or without battery power would be extremely advantageous, particularly in outdoor environments. The ability to incorporate safety features without negatively impacting the size, weight or user interface of a communication device is highly desirable. The fewer items a user has to carry, the better.

Accordingly, there is a need to provide increased safety features in a portable communication device.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
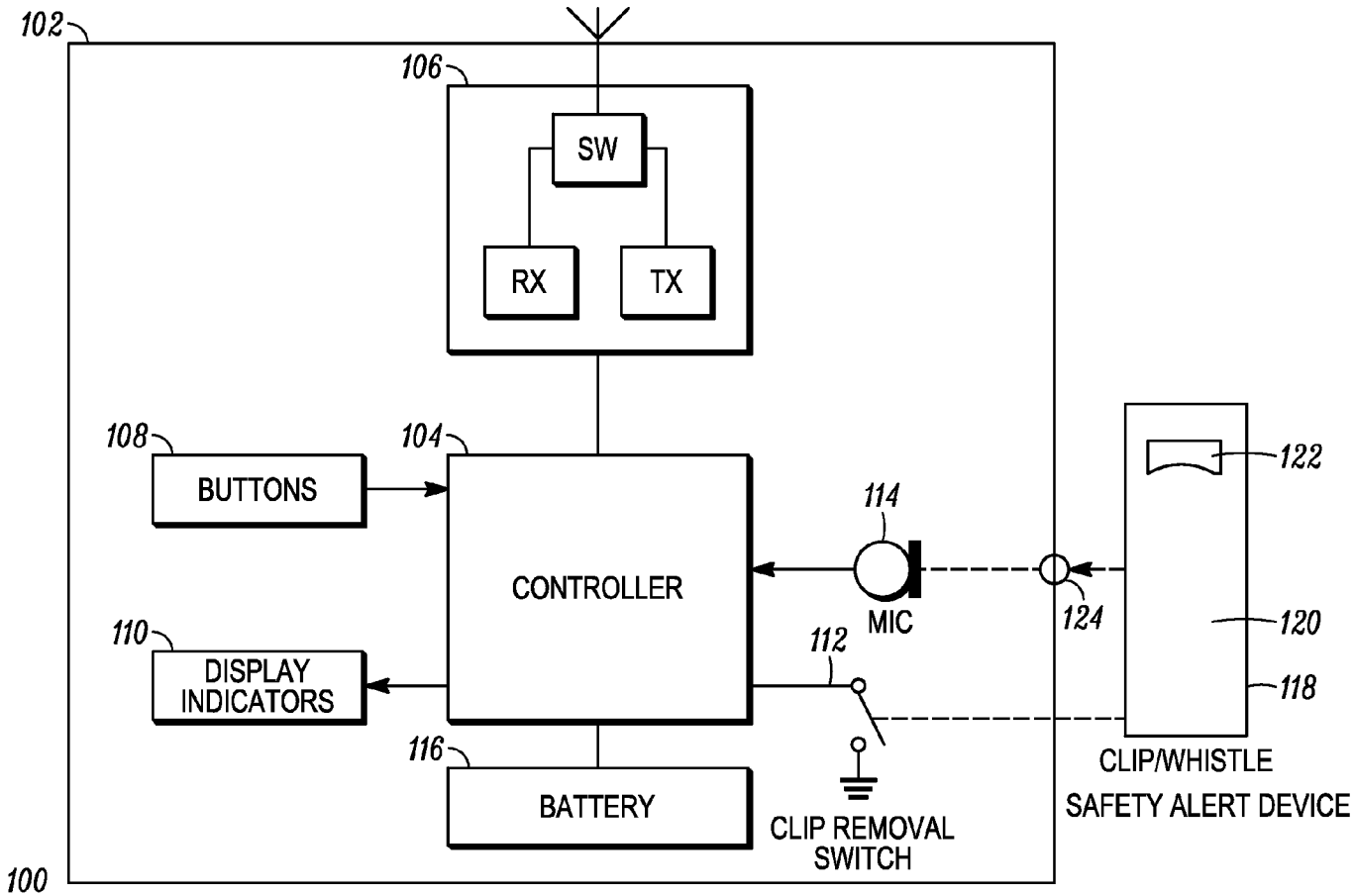
FIG. 1 is a block diagram of portable communication device formed in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, in accordance with the various embodiments to be described herein, there is provided a safety alert device comprising a clip having an integrated whistle formed therein. The clip may comprise a belt clip for a portable communication device, such as a two-way radio belt clip, or a lapel clip for a two-way radio accessory, such as a microphone lapel clip. The integration of the whistle within the clip of a two-way radio device or two-way radio accessory provides a dual-function user interface comprising a safety alert and clip. The whistle can also enable an emergency radio mode of operation when the clip is removed or rotated.

FIG. 1 is a block diagram of portable communication device 100 formed in accordance with some embodiments. The portable communication device 100 comprises a housing 102 within which are operatively coupled a controller 104, a transceiver 106, operational buttons 108, such as a push-to-talk button, a volume knob, and channel control buttons, and display indicators 110. A battery 116 for powering the portable communication device may be coupled within or outside of the housing 102. In accordance with the embodiments, a safety alert device 118 comprising a clip 120 is coupled to the housing 102, and the clip 120 comprises a whistle 122 integrated therein. The clip 120 may be rotatable or removable from the housing 102 using any one of a variety of mounting mechanisms known or yet to be developed.

The safety alert device 118 provides a user with the ability to generate an audible alert by blowing into whistle 122. This alert will facilitate locating the user in cases of an emergency. The whistle 122 is operational to provide safety alerts regardless of the battery status of the communication device 100.

For situations where battery power is available, the controller 104 of communication device 100 senses removal or re-orientation of the clip 120 and detect tones generated by the whistle 122 being blown by a user to trigger an emergency mode of operation. The radio emergency mode may initiate one or more of a plurality of emergency radio operating features such as emergency signaling, channel selection, visual signaling, and volume level increase to a predetermined level to name a few.

The controller 104 enables the emergency radio operation mode based on the removal or re-orientation of the safety alert device 118 from the housing 102 and sounding of the whistle 122. In some embodiments, the portable communication device 100 comprises a switch 112 and/or one or more microphones 114 aligned with microphone port 124. The switch 112 is triggered upon removal or re-orientation of the clip 120 from the housing 102. Triggering of the switch 112 alerts the controller 104 that the safety alert device 118 has been re-oriented or removed from the communication device 100.

To avoid false triggering of the emergency mode, such as by inadvertent snap off of a belt clip or other clip positions, the combination of removal or re-orientation of the clip along with the receipt of whistle tones is used as the basis for triggering emergency mode radio operation.

In response to the 112 switch being triggered, the controller 104 enables microphone 114. Microphone 114 receives tones at microphone port 124. Any microphone of the device 100 can be utilized to detect tones or a dedicated microphone may also be assigned. In this embodiment, both the switch 112 being triggered and the detection of tones by the microphone 114 from the whistle 122 are used as a basis for the radio entering into the emergency mode of operation. Thus, both the communication device 100 and the individual user blowing the whistle of safety alert device 118 can facilitate locating the user in an emergency situation when battery power is available. If battery power does run out, the whistle 122 integrated within the clip 120 of safety alert device 118 is still available to the user to continue generating tones as a standalone device.

Although the embodiments describe an audible tone, there may be embodiments in which a high frequency tone such as one that can only be heard by dogs may be suitable, such as for a mail carrier. The controller 104 may be configured to selectively detect a predetermined cadence or sequence of whistle tones. Thus, the controller may recognize a sequence of tones for emergency while another sequence or cadence of tones may be detected non-emergency usage, such as a whistle being used for traffic control. The recognition of the sequence or cadence of tones by the controller 104 thus allows the whistle to be used in both emergency and non-emergency situations. In non-emergency situations, the controller's recognition of non-emergency tones will not trigger the radio emergency mode. Thus, removal or re-orientation of the clip does not automatically trigger the emergency radio mode of operation. It takes both the removal of the clip and the sounding of the whistle, or the re-orientation of the clip and the sounding of the whistle, and in some embodiments a particular sounding of the whistle, for example, three short blasts, to enter the emergency radio mode.

Figure 2B:
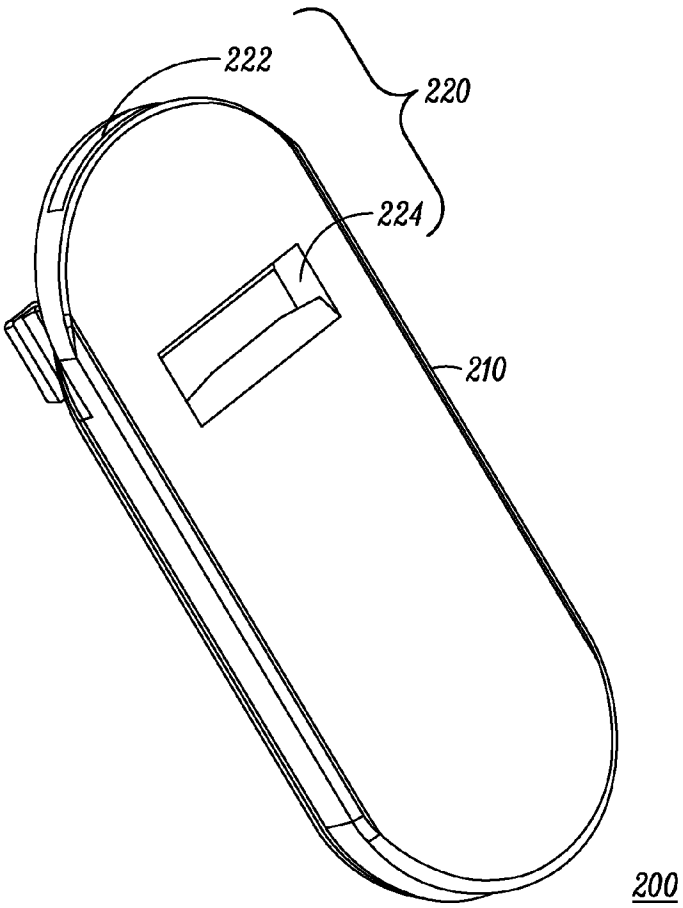
FIGS. 2A and 2B are first and second views of a safety alert device in accordance with some embodiments.
Figure 2A:
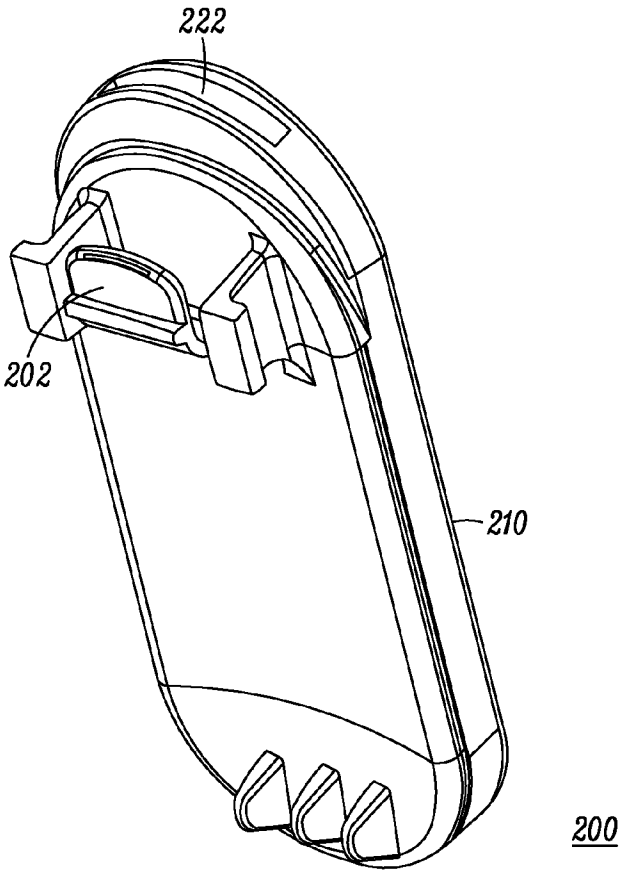

FIGS. 2A and 2B are first and second views of a safety alert device 200 formed in accordance with some embodiments. Safety alert device 200 comprises a clip 210 having a whistle 220 integrated therein in accordance with some embodiments. The safety alert device 200 may comprise a portable radio belt clip or a remote radio microphone lapel clip. The clip 210 and integrated whistle 220 are formed as a unitary piece part, such as a molded plastic material. The safety alert device 200 comprises mounting apparatus 202 which may comprises a push tab, slide tab, rotatable plate and/or other mounting apparatus known in the art that permits removal and/or re-orientation of the clip. In some embodiments, the mounting apparatus 202 allows the clip 210 to be attached and detached from a communication device housing, such as a portable two-way radio or remote radio microphone. Alternatively, in other embodiments, the mounting apparatus allows the safety alert device 200 to rotate, swivel, or pivot on the housing so that user access to the whistle is provided without removal of the clip. The action of removing the clip or re-orientating the clip is detected by the controller 104 of FIG. 1.

The whistle 220 may be integrated in different areas of the clip 210, however the whistle 220 is shown here as having an input 222 at one end of the clip into which a user can blow, and an output along a side portion of the clip from which the audible sound is generated.

Figure 3:
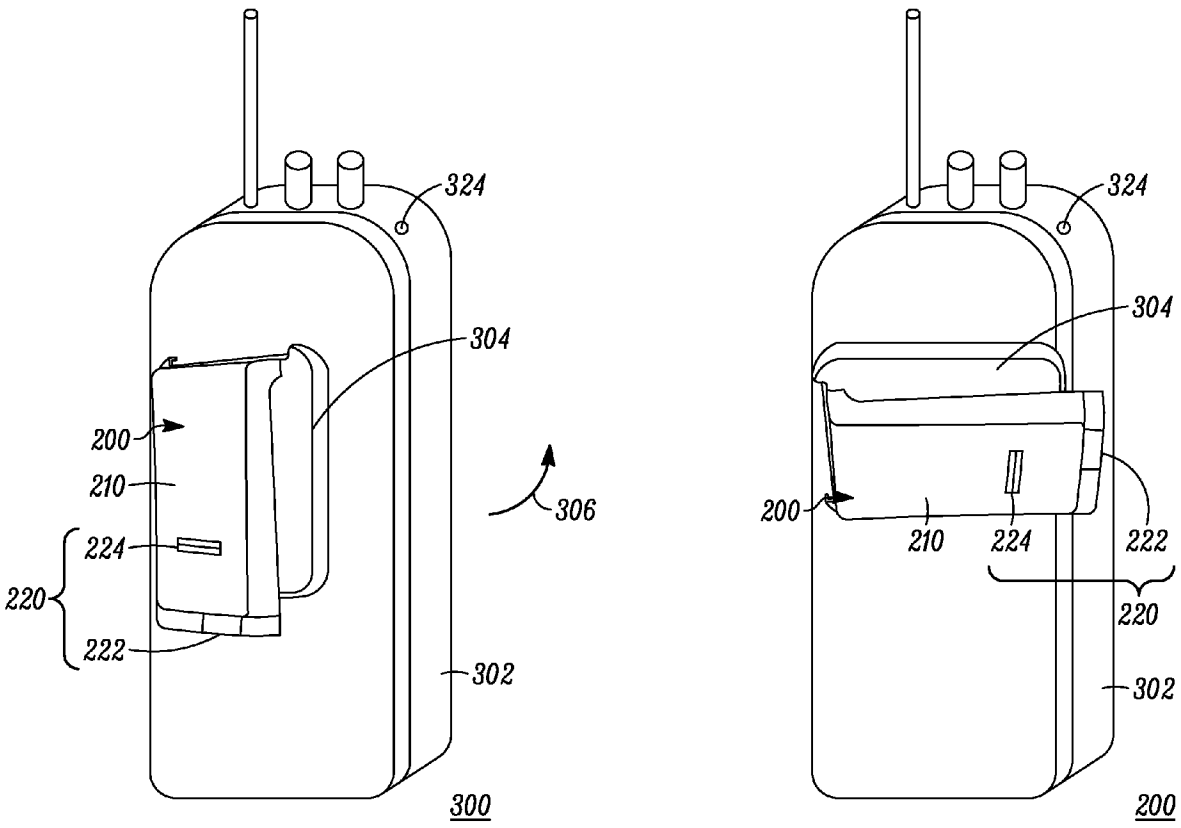
FIG. 3 shows the safety alert device mounted to a swivel mounting apparatus rotatably coupled to a housing of a radio in accordance with some embodiments.

FIG. 3 shows the safety alert device 200 mounted to a swivel mounting apparatus 304 rotatably coupled to housing 302 of a portable radio 300. The swivel mounting apparatus 304 allows the safety alert device 200 to be re-oriented through a rotational movement 306. The rotation of the swivel mounting apparatus 304 provides user access to the whistle 220. A user can rotate the swivel mounting apparatus 304 and blow into the input 222 of the whistle 220 to generate the tones at the whistle output 224. Whistle tones can be detected at a microphone port 324 as previously described. Rotation back to the original position provides the clip 210 functionality. The embodiment of FIG. 3 allows the safety alert device 200 to remain coupled to the housing 302. Thus, the safety alert device 200 can be embodied in either removable or rotatable embodiments.

Figure 4:
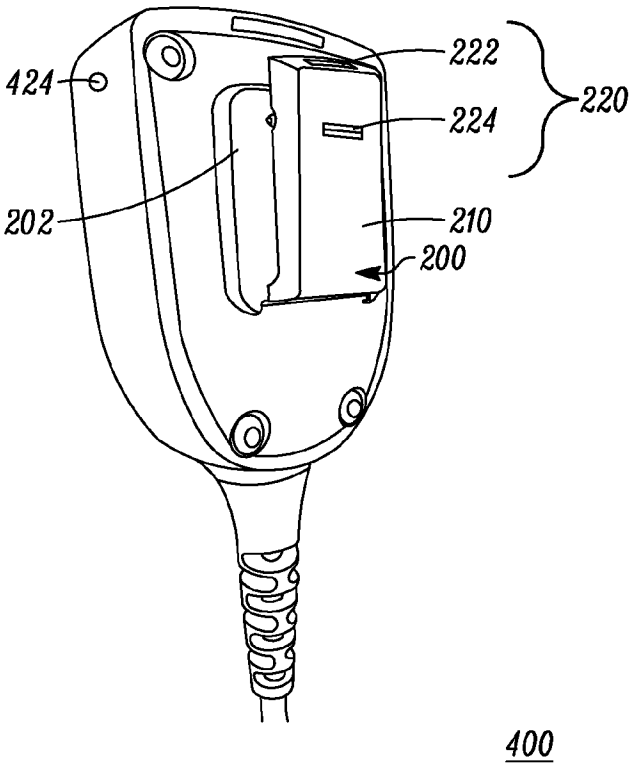
FIG. 4 shows the safety alert device mounted to a remote microphone in accordance with some embodiments.

While the safety alert device 200 is well-suited to radios being used in a leisure type environment, such as hiking and skiing and cycling, users within the public safety market can also take advantage of the user safety alert device. FIG. 4 shows a public safety device in the form of a remote radio microphone incorporating the safety alert device 200 in accordance with some embodiments. The remote radio microphone 400 is typically worn upon the shoulder of a user and held by a shoulder lapel. The remote radio microphone communicates is coupled via a wired or wireless connection with a portable radio communication device such as that described in FIG. 1. The attachment and detachment of the safety alert device 200 can be achieved using a variety of attachment/detachment mechanisms known or yet to be developed. For example, swivel clips, extension clips, slide-in clips and spring loaded clips to name a few. Whistle tones can be detected by a microphone port 424 as previously described. The remote microphone arrangement in FIG. 4 is advantageous because the microphone and the safety alert device 200 are readily accessible to the user.

For both the radio and the remote microphone case, the radio controller can be further configured to selectively listen for the specific audio signature of whistle 122 to minimize false actuation of the emergency communication mode. The selectivity can be fixed by the device manufacturer or it can be user-configurable or the device can even offer a learning mode to learn the user's whistle including an alternate whistle not associated with the device.

Figure 5:
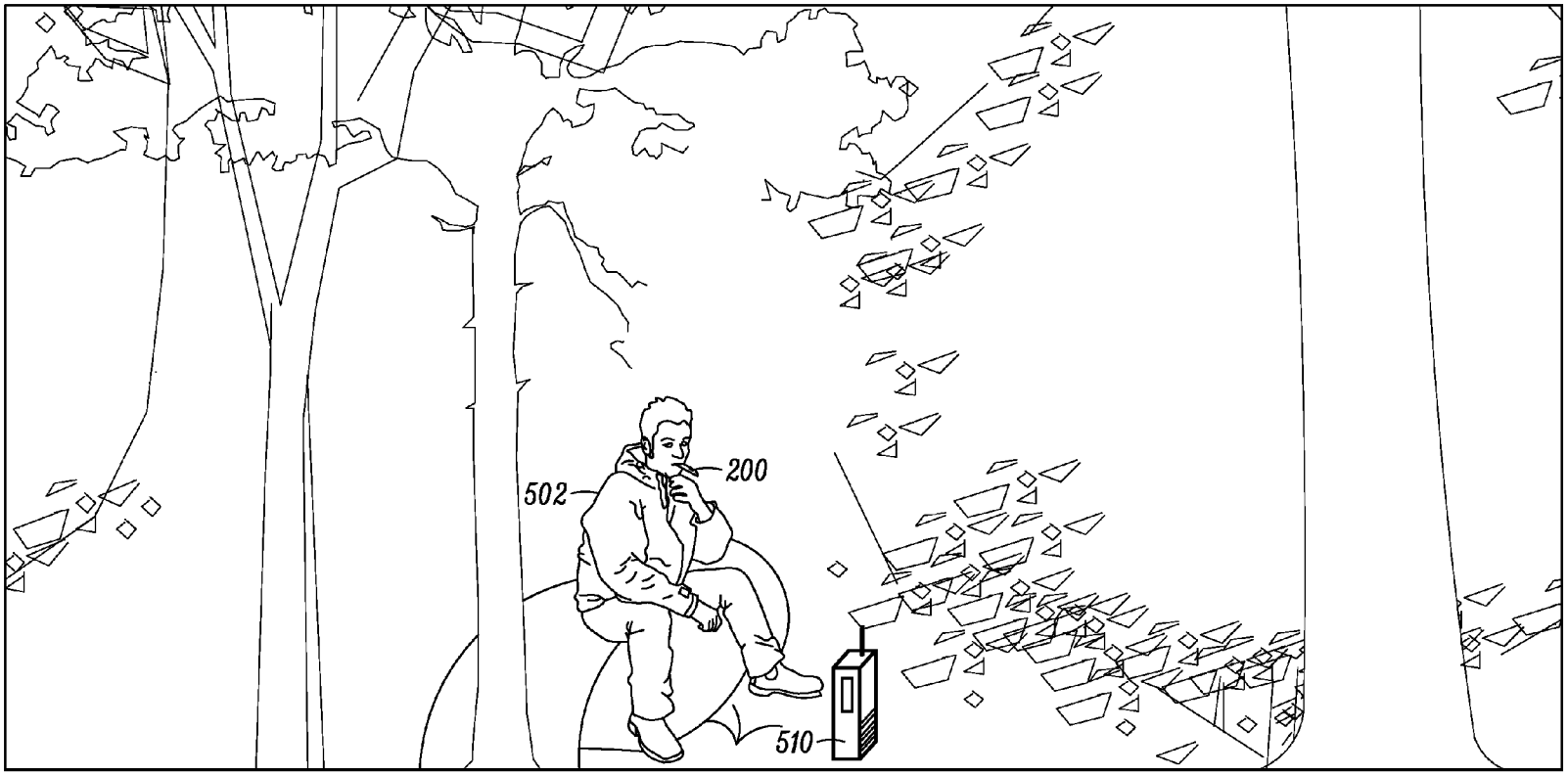
FIG. 5 shows an environmental usage example for the safety alert device in accordance with some embodiments.

FIG. 5 shows an environmental usage example 500 comprising the safety alert device 200 in accordance with some embodiments. In this embodiment, the clip 210 having integrated whistle 220 has been detached from a portable radio 510. The whistle is being blown by a user 502 to alert others of his location. For example, three short bursts may be used to help identify the user's location. If lost in the woods, the whistle 220 of clip 210 can also be blown by user 502 to help keep predators, such as bears or other animals, away. Thus, even if the portable radio 510 is in a discharged battery condition, the clip 210 having integrated whistle 220 provides an additional safety feature to the user.

If the battery still has power, then a further embodiment can take place wherein the controller 104 of portable radio 510 senses removal or re-orientation of the safety alert device 200 from the radio housing and enables a radio microphone. In response to the removal (or re-orientation) of the clip and sound of the whistle being blown, the portable radio enters into an emergency mode of operation. For example, clip removal switch 112 and microphone 114 from FIG. 1 may be operated as previously described.

In accordance with some embodiments, the microphone 114 only monitors for audible whistle tones when the controller 104 detects removal (or re-orientation) of the clip 210 via the switch 112. Thus, the microphone 114 can play a part of regular radio operation in normal usage as well as further facilitate the safety feature operation. Again, the portable radio 510 enters into an emergency mode in response to the microphone 114 detecting the audible tone from the whistle. The emergency mode enables the radio's controller to initiate at least one of a plurality of emergency radio operating features such as: emergency signaling, channel selection, visual signaling, and volume level increase to a predetermined level.

As the radio loses battery power, the user is still able to continue to use the whistle. Thus, the embodiments provide for safety alerts (whistle and emergency radio mode operation) while battery power is still available, as well as safety alert (whistle alone) when the battery becomes discharged.

Accordingly, there has been provided an additional safety feature for a portable communication device. The whistle being integrated within the clip as a unitary piece part provides a dual function user interface without the use of additional piece parts. The safety alert device of integrating a whistle within a clip has been added without increasing the size or weight of the clip. The whistle may operate as a stand-alone device and/or tones from the whistle may be received by the radio for additional radio emergency mode operation when battery power permits. Even as the battery power in the radio discharges, the user still has access to the stand-alone operation of the whistle.

Unlike systems with dangling members and attachments, the integrated clip and whistle provided by the various embodiments has no components getting in the way of using the portable communication device. The dual functionality provides both a belt clip or lapel clip and a whistle in a two-for-one form factor which maintains a slim form factor. The portable communication device comprising the safety alert device described by the various embodiments can be used in a variety of environments. For example, the portable communication device comprising the safety alert device can be used in outdoor activity environments, such as for camping where a user might be lost in the woods; in construction sites, such as where a worker might be trapped under debris; and public safety environments, such as an officer handling traffic in non-emergency situations or an officer seeking assistance in an emergency situation. The controller's ability to detect a plurality of different sequences or cadences emanating from the whistle facilitates minimizes false triggering and provides for both emergency and non-emergency use of the whistle.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and Ics with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A safety alert device, comprising:

a clip for coupling to a portable communication device; and a whistle integrated within the clip, and wherein orientation of the clip and detect tones generated by the whistle trigger an emergency mode of operation of the portable communication device.

2. The safety alert device of claim 1, wherein the clip comprises at least one of: a portable radio belt clip and a remote radio microphone lapel clip.

3. The safety alert device of claim 1, wherein the clip and integrated whistle are formed as a unitarily molded piece part.

4. The safety alert device of claim 1, wherein the clip is removable from the communication device.

5. The safety alert device of claim 1, wherein the clip is rotatable from the communication device.

6. A portable communication device, comprising:
a housing;
a safety alert device coupled to the housing, the safety alert device comprising:
a clip coupled to the housing; and
a whistle integrated within the clip, wherein the safety alert device provides whistle operation while the portable communication device provides emergency mode operation in response to rotation of the clip from the housing in conjunction with audio generated from the whistle.

7. The portable communication device of claim 6, wherein the clip is detachable from the housing for providing user access to the whistle.

8. The portable communication device of claim 6, wherein the clip is rotatable from the housing for providing user access to the whistle.

9. The portable communication device of claim 6, wherein the clip and integrated whistle are formed of a unitary piece part.

10. A portable communication device, comprising:
a housing;
a safety alert device coupled to the housing, the safety alert device comprising:
a clip coupled to the housing; and
a whistle integrated within the clip, wherein the safety alert device provides stand-alone whistle operation while the portable communication device provides emergency mode operation in response to the removal of the clip from the housing in conjunction with audio generated from the whistle.

11. The portable communication device of claim 10, wherein the safety alert device continues to provide stand-alone whistle operation when the portable communication device is discharged.

12. A portable communication device, comprising:
a housing, comprising:
a controller;
a transceiver;
a battery for powering the portable communication device; and
a safety alert device coupled to the housing, the safety alert device comprising a clip having an integrated whistle, wherein the controller detects removal or re-orientation of the safety alert device and senses whistle tones to enable an emergency mode of radio operation.

13. The portable communication device of claim 12, wherein the emergency mode radio operation enabled by the controller initiates at least one of: emergency signaling, channel selection, visual signaling, and volume level increase.

14. The portable communication device of claim 12, further comprising:
a microphone coupled to the controller for detecting tones generated from the whistle.

15. The portable communication device of claim 12, wherein the whistle is integrated with the clip as a unitary piece part for operating as a dual function user interface of a clip and whistle.

16. The portable communication device of claim 13, further comprising:
a switch coupled between the controller and the clip, the switch indicating removal of the clip from the portable communication device.

17. The portable communication device of claim 12, further comprising:
a switch coupled between the controller and the clip, the switch indicating re-orientation of the clip from the portable communication device.

18. The portable communication device of claim 12, wherein the whistle operates as a safety alert when the battery of the portable communication device is either charged or discharged.

19. The portable communication device of claim 12, wherein the controller selectively listens for a specific audio signature of the whistle.

20. A portable communication device, comprising:
a housing, comprising:
a controller;
a transceiver;
a battery for powering the portable communication device; and
a safety alert device coupled to the housing, the safety alert device comprising a clip having an integrated whistle, wherein the controller identifies a plurality of different whistle cadences or sequences to identify between emergency radio mode operation and a non-emergency radio mode operation.

* * * * *